US010087624B2

(12) United States Patent
Gnutik

(10) Patent No.: US 10,087,624 B2
(45) Date of Patent: Oct. 2, 2018

(54) DRYWALL CONSTRUCTION FOR RESONANCE SOUND ABSORPTION

(71) Applicant: Knauf Gips KG, Iphofen (DE)

(72) Inventor: Andrey Gnutik, Moscow (RU)

(73) Assignee: KNAUF GIPS KG, Iphofen (DE)

( * ) Notice: Subject to any disclaimer, the term of this patent is extended or adjusted under 35 U.S.C. 154(b) by 0 days.

(21) Appl. No.: 15/669,532

(22) Filed: Aug. 4, 2017

(65) Prior Publication Data

US 2018/0023294 A1 Jan. 25, 2018

Related U.S. Application Data

(63) Continuation of application No. PCT/EP2015/000981, filed on May 13, 2015, which is a continuation of application No. PCT/EP2014/003375, filed on Feb. 11, 2015.

(51) Int. Cl.

| | |
|---|---|
| ***E04B 2/74*** | (2006.01) |
| ***E04B 1/86*** | (2006.01) |
| ***G10K 11/172*** | (2006.01) |
| *E04B 1/84* | (2006.01) |

(52) U.S. Cl.

CPC ..... *E04B 2/7409* (2013.01); *E04B 1/86* (2013.01); *G10K 11/172* (2013.01); *E04B 2001/849* (2013.01); *E04B 2001/8461* (2013.01)

(58) Field of Classification Search

CPC ..... E04B 2/7409; E04B 1/86; E04B 2/7412; E04B 2001/8461; E04B 2001/8476; E04B 1/84; E04B 1/82; E04B 2001/8263; E04B 1/8209; G10K 11/172; G10K 11/04

See application file for complete search history.

(56) References Cited

U.S. PATENT DOCUMENTS

| | | | | |
|---|---|---|---|---|
| 3,507,355 | A * | 4/1970 | Lawson | E04B 1/86 181/292 |
| 4,084,367 | A * | 4/1978 | Saylor | B29D 24/005 428/113 |
| 6,021,612 | A * | 2/2000 | Dunn | E01F 8/007 181/286 |
| 6,358,590 | B1 * | 3/2002 | Blair | B23K 15/085 428/73 |
| 8,739,924 | B2 * | 6/2014 | Johnson | E04B 1/86 181/284 |
| 8,820,476 | B2 * | 9/2014 | Nam | E04L 2/7409 181/284 |
| 2005/0188626 | A1 * | 9/2005 | Johnson | E04L 2/7412 52/144 |

(Continued)

FOREIGN PATENT DOCUMENTS

| | | | | |
|---|---|---|---|---|
| GB | 2489486 | * 10/2012 | | E04B 1/88 |

*Primary Examiner* — Beth A Stephan

(74) *Attorney, Agent, or Firm* — Mark Terry

(57) ABSTRACT

The invention relates to a drywall construction for resonance sound absorption. The drywall construction comprises a plurality of drywall profiles and fixed thereto at least one layer of plasterboards having an opening arranged therein. The drywall construction further comprises a resonance chamber in fluid connection with the opening, the resonance chamber and the opening having a size and shape so that sound of predetermined resonance frequencies enters the resonance chamber via the opening.

12 Claims, 5 Drawing Sheets

(56) References Cited

U.S. PATENT DOCUMENTS

| | | | | |
|---|---|---|---|---|
| 2006/0000670 | A1* | 1/2006 | Dodd | E04L 2/7409<br>181/285 |
| 2016/0071507 | A1* | 3/2016 | Kim | G10K 11/172<br>181/286 |
| 2016/0102455 | A1* | 4/2016 | Burr | E04C 2/523<br>52/145 |

* cited by examiner

DRYWALL CONSTRUCTION FOR RESONANCE SOUND ABSORPTION

CROSS-REFERENCE TO RELATED APPLICATIONS

This patent application claims priority to, and is a continuation of, international application number PCT/EP2015/000981 filed May 13, 2015, which claims priority to international application number PCT/EP2014/003375 filed Feb. 11, 2015. The subject matter of international application numbers PCT/EP2015/000981 and PCT/EP2014/003375 are hereby incorporated by reference in their entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

BACKGROUND

One particular example for a conventional drywall construction is a separation wall. The separation wall is formed by a sub-construction to which plasterboards are screwed. The fixed plasterboards form a closed layer which is the basis for the application of coating materials, wall colors, etc. The sub-construction is made by a plurality of drywall profiles, each profile being aligned corresponding to the orientation of the finished wall.

A conventional drywall profile has a cross section comprising a first flange portion and parallel thereto a second flange portion, both flange portions being connected by a base portion so as to form a u-shape. The plurality of drywall profiles are arranged so that the first flange portions allow for fixing a first layer of plasterboards thereto, and the second flange portions allow for fixing a second layer of plasterboards thereto, which means that the flange portions are arranged in a common plane. The size of the base portion defines the distance between both layers of the attached plasterboards.

Such a layer of plasterboards can be a single layer, a double layer or a multiple layer of plasterboards. Additional layers are sometimes preferred to increase the physical properties of the entire construction.

A high-quality example for the plasterboard is the KNAUF gypsum plasterboard with the product name "diamond" which provides an excellent overall quality. However, the meaning of the term "plasterboard" is understood to be very broad so as to include gypsum plasterboards of specific characteristics, like fire resistance, etc. The term "plasterboard" is defined herewith so as to include plate shaped building panels which can be applied to a drywall sub-construction.

Acoustics in a room can be influenced by the installation of specific drywall constructions, like acoustic walls or acoustic ceilings. Acoustic walls do acoustically separate two rooms so that noise generated in one room is attenuated by the wall so as to be less perceivable in the other room. The use of such acoustic walls provides strong attenuation compared to other wall types.

Room acoustics deal with sound behavior in an enclosed space. The soundwave propagates in the enclosed space of the room and is reflected at the walls, floor and ceiling. The acoustics of a room can be changed by attenuating the sound wave. Attenuation of sound waves can be achieved in many ways, inter alia by damping, diffusion, reflection or absorption.

For example in the widely used drywall construction of an acoustic ceiling, the sound is attenuated by reflection. The sound wave propagating in the room enters the space behind the plasterboard via perforations formed in the plasterboard. In the space behind the plasterboard sound waves propagate and are reflected at the surfaces (e.g. raw ceiling) and peters out in the space between the plasterboard and the raw ceiling.

It is generally possible to achieve sound attenuation by way of acoustic resonance sound absorption, either. A resonant absorber damps the sound wave by reflection thereof. One example for a resonant absorber is a plate resonator which is described in the prior art document DE1950651 1. The plate resonator is used for damping sound of low frequencies in a room, like a concert hall. The plate resonator basically consists of a thin front plate with low internal friction and a thick back plate with high internal friction which are firmly connected to each other.

The plate resonator has the disadvantage that it needs much space to be mounted at the surface of the wall. A further disadvantage is the visual appearance since the plate resonator covers a huge portion of the wall and makes a very technical optical impression.

Another example for a resonant absorber is a Helmholtz resonator. This technique is known from ancient times when clay jugs where arranged in churches to provide a resonant volume for improving the acoustics. The Helmholtz resonator couples sound waves into the volume of a resonance chamber via an opening in the chamber. The sound absorption is achieved for frequencies close to the resonance frequency of the Helmholtz resonator which is related to the size and shape of the volume of the chamber and of the size and shape of the opening through which sound enters the resonator chamber. The damping effect occurs for frequencies which are a multiple of the resonance frequency (1., 2., 3., . . . order harmonics) as well. Wherein damping intensity decreases for an increasing higher order of the resonance frequency.

Therefore, a need exists to address the problems with the prior art with regard to resonance sound absorption.

SUMMARY

This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

The claimed subject matter relates to drywall constructions for resonance sound absorption. The drywall construction comprises a plurality of drywall profiles and fixed thereto at least one layer of plasterboards having an opening arranged therein. The drywall construction further comprises a resonance chamber in fluid connection with the opening, the resonance chamber and the opening having a size and shape so that sound of predetermined resonance frequencies enters the resonance chamber via the opening.

BRIEF DESCRIPTION OF THE DRAWINGS

In the following the invention will be explained in more detail with reference to drawings. Like reference numerals denote similar features throughout the drawings. Aspects shown in the drawings can be connected and combined with each other in any technically possible way.

DETAILED DESCRIPTION

Figure 1:
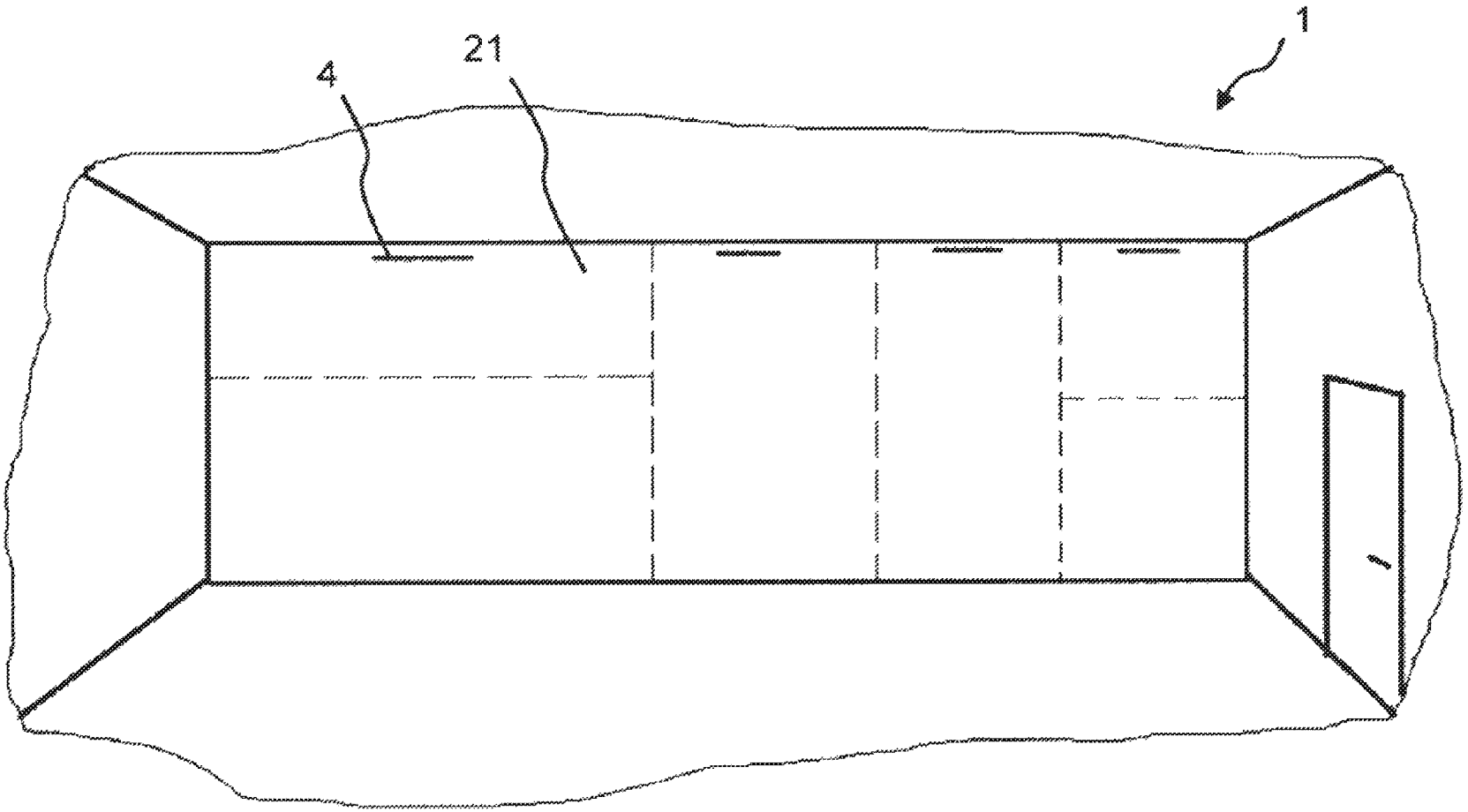
FIG. 1 is a perspective illustration of a room with a drywall construction according to the invention.

The invention relates to drywall constructions for resonance sound absorption. The object of the invention is therefore to provide a drywall construction for resonance sound absorption which overcomes or at least reduces the problems in the prior art. A further object is to provide a drywall construction particularly capable of attenuating sound in the low frequency spectrum. The problem is solved by a drywall construction for resonance sound absorption according to the independent claim. Further advantageous embodiments form the subject matter of the respective dependent claims.

A drywall construction for resonance sound absorption according to the invention comprises a plurality of drywall profiles and fixed thereto at least one layer of plasterboards having an opening arranged therein. The drywall construction further comprises a resonance chamber in fluid connection with the opening. Size and shape of the resonance chamber and the opening are dimensioned such that at least one resonance frequency of the resonance chamber conforms to at least one frequency of sounds to be absorbed.

The drywall construction is capable of attenuating sound propagating in a room by that the sound enters the resonance chamber via the opening. The size and shape of the resonance chamber is chosen to attenuate sound with predetermined frequencies. In specific examples, the size and shape of the opening and the resonance chamber is chosen accordingly. The frequencies are predetermined insofar as for example in the case of that sound of a predetermined frequency below 125 Hz is to be attenuated, the size and shape can be chosen either by experiment or by calculation.

Advantageously the drywall construction has the resonance chamber of a size of $V=(c^2/4\pi^2/)(s/lf^2)$, wherein c is the sound velocity in air (i.e. 340 m/s), s is the cross-section of the opening, 1 is the thickness (deepness) of the opening and f the frequency to be absorbed.

It is preferred if the resonance chamber has a size V for the attenuation of sound of a frequency $f<125$ Hz, wherein the opening has a size of the dimensions $s=0.01$ m×0.1 m and $1=0.025$ m (thickness of a double layer). The dimensions of the resonance chamber in the wall can be thickness $t=0.1$ m and width $d=0.6$ m, wherein the height of the chamber can be the height of the wall or a suitable smaller intersection.

In a particular advantageous aspect, a sound attenuation element is arranged in the resonance chamber. The sound attenuation element is in one example a mineral wool or a glass wool. The sound attenuation element changes the sound characteristic by reducing the peak intensity and simultaneously by shifting the peak intensity to lower frequencies. The attenuation element can be of any material that scatters the propagating sound wave in a manner to reduce the overall intensity of the sound wave.

According to a first alternative aspect of the invention, the drywall construction comprises one layer of plasterboards fixed to the drywall profiles. The resonance chamber is arranged at the side of the plasterboards which is fixed to the drywall profiles. Hence, the advantages of the invention can be provided with a facing framework or in a ceiling construction. The facing framework can be a single layer of plasterboards attached to drywall profiles which are arranged to cover a brick wall for example.

According to a second alternative aspect of the invention the drywall construction comprises two layers of plasterboards, the first of which being fixed to a first side of the drywall profiles and the second of which being fixed to a second side of the drywall profiles which is arranged opposite to the first side. The resonance chamber is arranged between the two layers of plasterboards. This allows to provide the advantages of the invention in a known separation wall.

According to a third alternative aspect of the invention the drywall construction comprises three layers of plasterboards, a first of which being fixed to a first side of the drywall profiles and a second of which being fixed to a second side of the drywall profiles. A further plurality of drywall profiles is fixed to one of the first layer or the second layer of the three layers of plasterboards and a third layer of the three layers of plasterboards being fixed to the further plurality of drywall profiles. The resonance chamber is arranged between two layers of the three layers of plasterboards: That aspect is preferred as it provides the advantages of the invention in a robust two double stud drywall construction.

Preferably, a further resonance chamber is arranged between two other layers than the two layers between which the resonance chamber is arranged, the further resonance chamber being in fluid connection with a further opening. The further resonance chamber allows for changing the spectrum of the absorbed sound frequencies, in particular the further resonance chamber of a different volume than the resonance chamber has the advantage to broaden the spectrum of absorbed sound frequencies.

It is moreover preferred if at least one of the at least one layer of plasterboards is a double layer of plasterboards. A double layer of plasterboards increases the mass of the layer of plasterboards. An increase of the mass of the layer of plasterboards in a separation wall improves attenuation.

According to one aspect an elastic lining is arranged between the double layer of plasterboards. The elastic lining, e.g., a soundproofing membrane, acoustically decouples the directly attached two plasterboards which form the double layer.

In another aspect the resonance chamber comprises an outer wall of plasterboards. The at least one layer of plasterboards is at least a portion of the outer wall. This allows to integrally arrange the resonance chamber in the space formed in drywall constructions. One example is the space between two layers of plasterboards which form the outer linings of a separation wall.

One alternative aspect relates to that the resonance chamber comprises a separate outer wall. The separate outer wall can be a plasterboard which forms no part of the drywall construction. In another example, the separate wall can be made of wood, metal, etc.

Preferably, the separate outer wall has a box shape or a cylindrical shape. The cylindrical shape can be used to form a tube like element. A maximum attenuation of sound can be achieved by the combination of different sized and shaped chambers. In one example the tube resonator chamber or the box shaped resonator chamber of a size and shape to be capable for attenuation of standing room sound waves are (additionally) included in the drywall construction.

Advantageously, the separate outer wall has an adjustable size so as to be capable of changing the volume of the resonance chamber. In the example of a tube resonance chamber, the adjustable size can be achieved by a tube-in-tube configuration in which both tubes are movable relative to each other to change the size and shape of the resonance chamber.

Preferably, the drywall construction further comprises an elastic element, e.g., a soundproofing membrane, for acoustic decoupling of the profile and the plasterboard, the elastic element being arranged between the drywall profile and the first plasterboard attached to the drywall profile, i.e. the plasterboards which are in direct contact with the profile.

The claimed subject matter will now be described with reference to the figures. FIG. 1 illustrates a perspective view of a room with a drywall construction 1 according to the invention which forms the walls of the room. The shown drywall construction allows for resonance sound absorption and is particularly capable of attenuating sound in the frequency spectrum below 125 Hz.

The walls are covered by a layer of plasterboards 21. The dashed lines illustrate the size of the resonance chambers (not shown) which are arranged behind the plasterboards. Different sizes of the resonance chambers are exemplified. Four openings 4 are formed in the upper end portion of the plasterboards, each opening 4 having the size of 1 cm×10 cm and a deepness of 2.4 cm (which corresponds to the thickness of a double layer of plasterboards).

Sound propagating in a room can enter the resonance cavities behind plasterboards 21 via openings 4. The drywall construction has the resonance chamber of a size of $V=V=(c^2/4\pi^2/)(s/lf^2)$ which is preferably chosen for the attenuation of sound of a frequency $f<125$ Hz.

Figure 2:
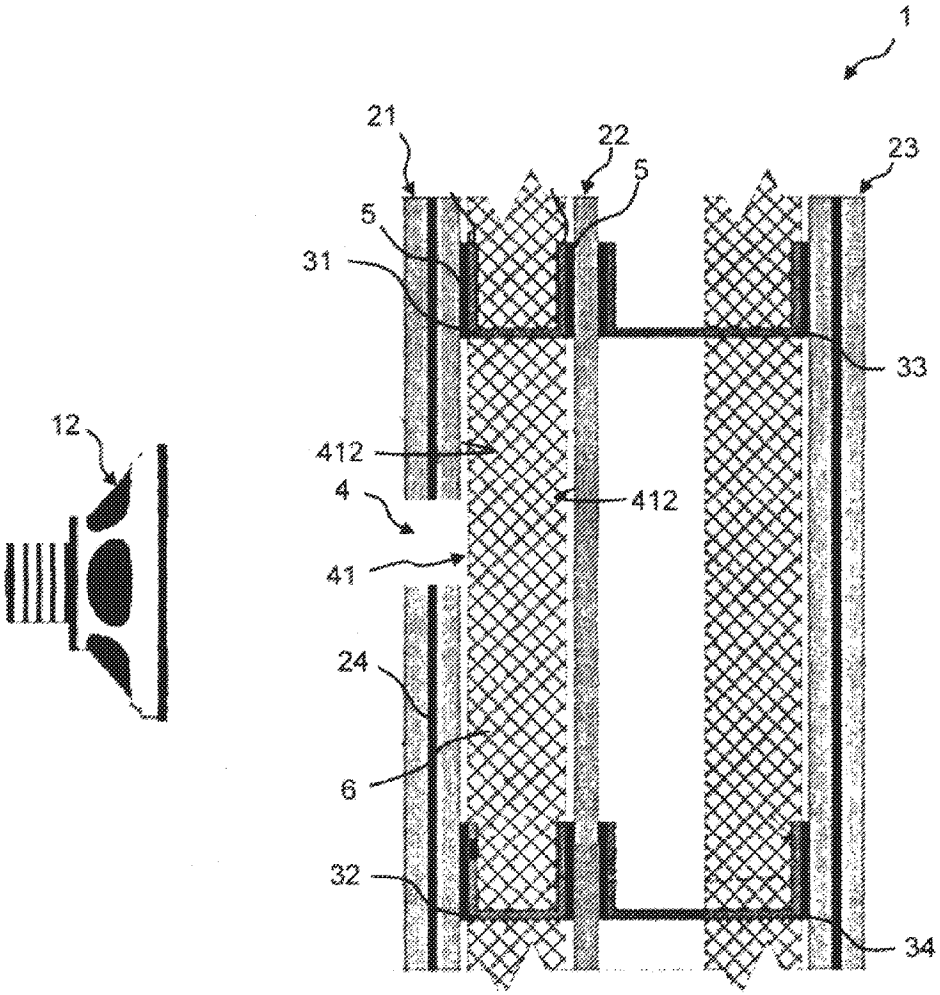
FIG. 2 is a vertical cross section of a double stud separation wall.

FIG. 2 a vertical cross section of a double stud separation wall 1 with a speaker 12 arranged on the left-hand side which illustrates a source of sound.

Double stud separation wall 1 comprises three layers of plasterboards 21, 22, 23 which are fixed to pairs of studs 31, 33; 32, 34. Pairs of studs 31, 33; 32, 34 are arranged parallel in the direction of the wall thickness. The first layer of plasterboards 21 is a double layer with an elastic lining 24, e.g., a soundproofing membrane, arranged between the plasterboards. In the first layer 21 an opening 4 extending though the double layer which provides access for the sound to enter the resonance chamber 41. Resonance chamber 41 comprises an outer wall 412 of plasterboards. The outer wall 412 is formed by first layer of plasterboards 21 and by the second layer of plasterboards 22. Resonance chamber 41 is further confined by the adjacent drywall studs 31 and 32.

The sound characteristics are further improved by arranging a sound attenuation element 6 in resonance chamber 41 as well as by arranging an elastic element 5 for acoustic decoupling between the profile and the plasterboard, e.g., a soundproofing membrane.

Figure 3:
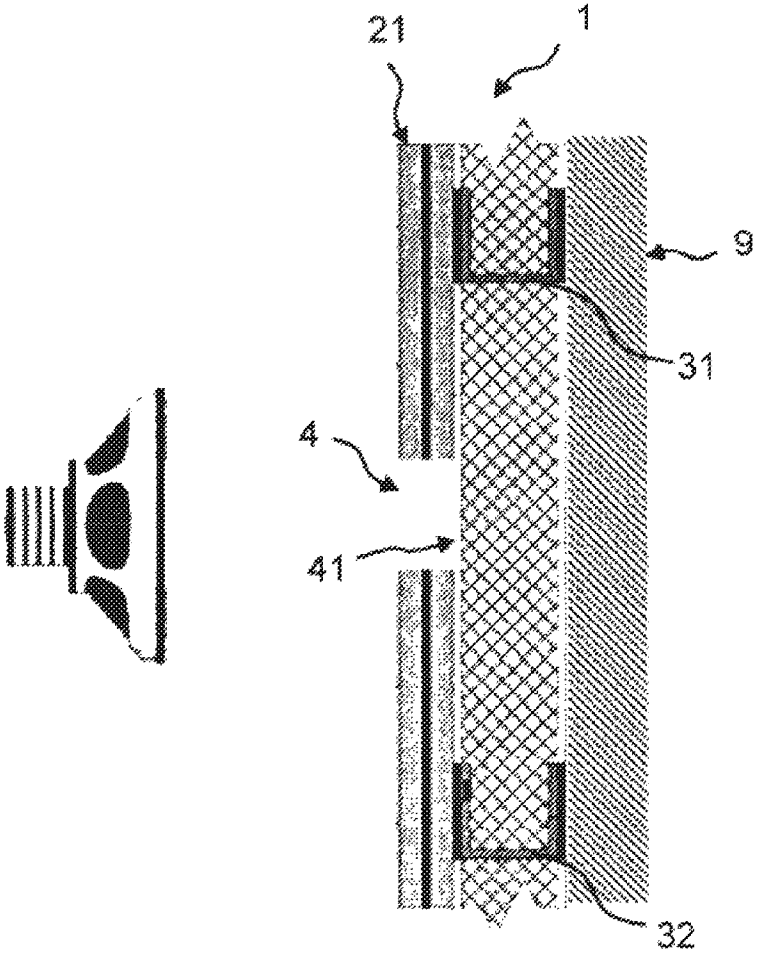
FIG. 3 is a vertical cross section of a single stud facing framework fixed to a brick wall.

FIG. 3 is a drywall construction 1 for use as facing framework in which one layer of plasterboards 21 is fixed to the drywall profiles 31, 32. In this example resonance chamber 41 is arranged at the side of the plasterboards 21 which is fixed to the drywall profiles 31, 32. The resonance chamber is a sound proof cavity formed between adjacent profiles 31, 32, the one layer of plasterboards 21 and the wall 9 which is covered by the facing framework. The size and shape of the cavity and the opening can be chosen according to the frequencies to be attenuated, as described herein.

Figure 4:
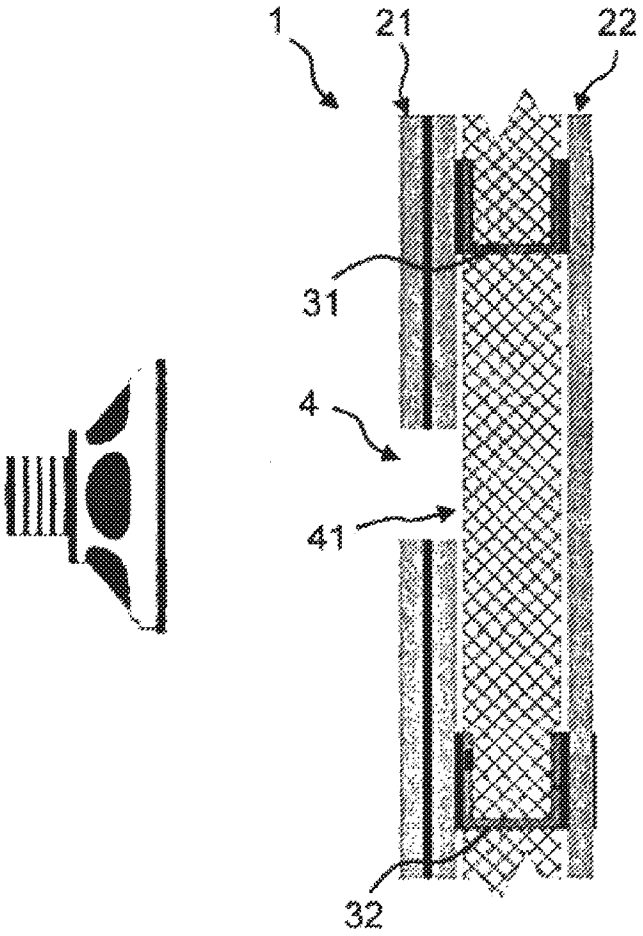
FIG. 4 is a vertical cross section of a single stud separation wall.

Another drywall construction is shown in FIG. 4 which is a single stud separation wall comprising two layers of plasterboards 21, 22. The first layer of plasterboards is a double layer which is fixed to a first side of the drywall profiles 31, 32. The second layer of plasterboards is fixed to a second side of the drywall profiles 31, 32. In this example the second layer is a single layer but it can be a multiple layer as well. The resonance chamber 41 is arranged between the two layers of plasterboards 21, 22 so that sound can enter the resonance chamber 41 via the opening 4 to be attenuated therein.

According to all embodiments of the invention the size and shape of the chamber and the opening is to be chosen to attenuate predetermined frequencies. Frequencies below 125 Hz are preferred.

Figure 6:
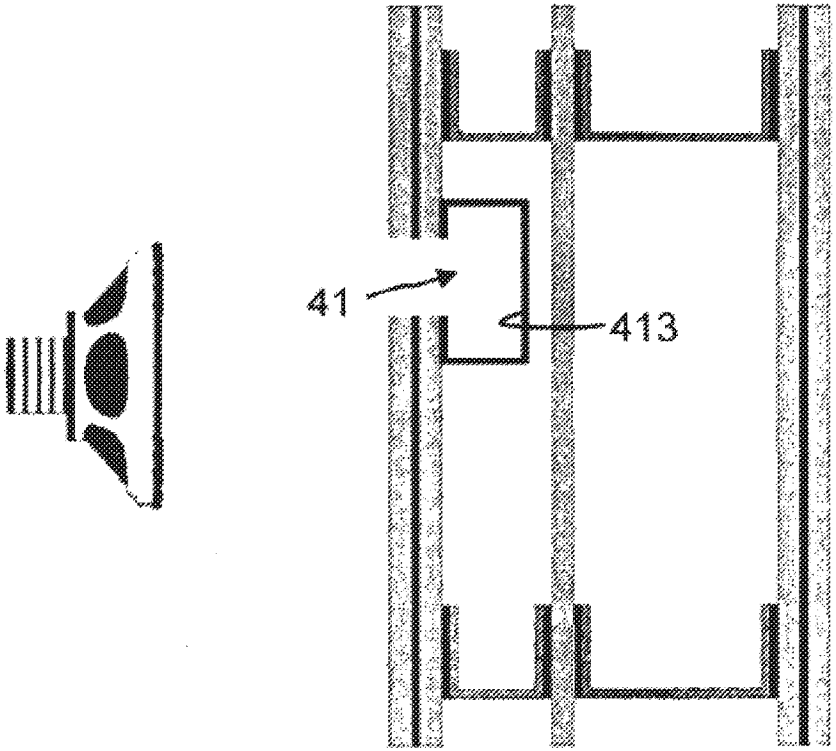
FIG. 6 is a vertical cross section of a double stud separation wall with different.
Figure 5:
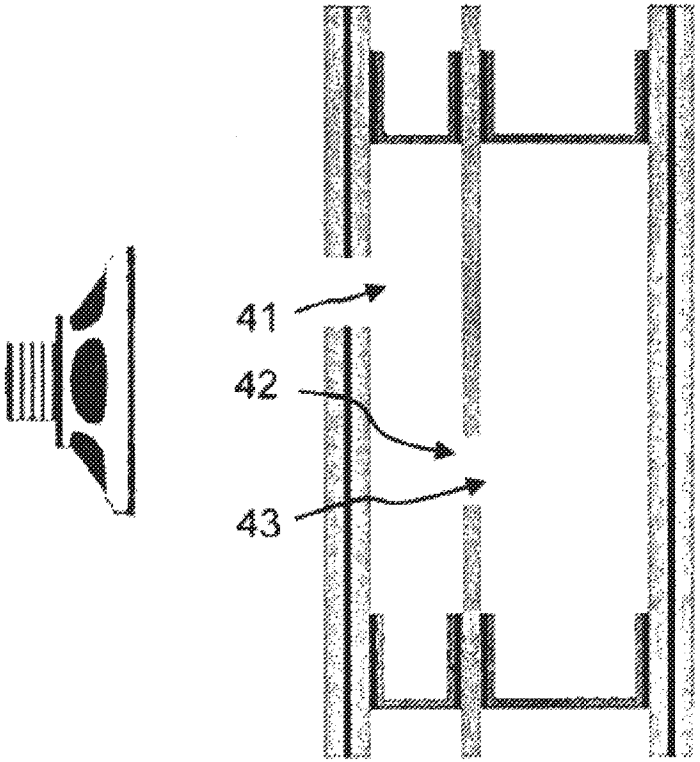
FIG. 5 is a vertical cross section of a double stud separation wall with a resonance chamber and a further resonance chamber.
Figure 7:
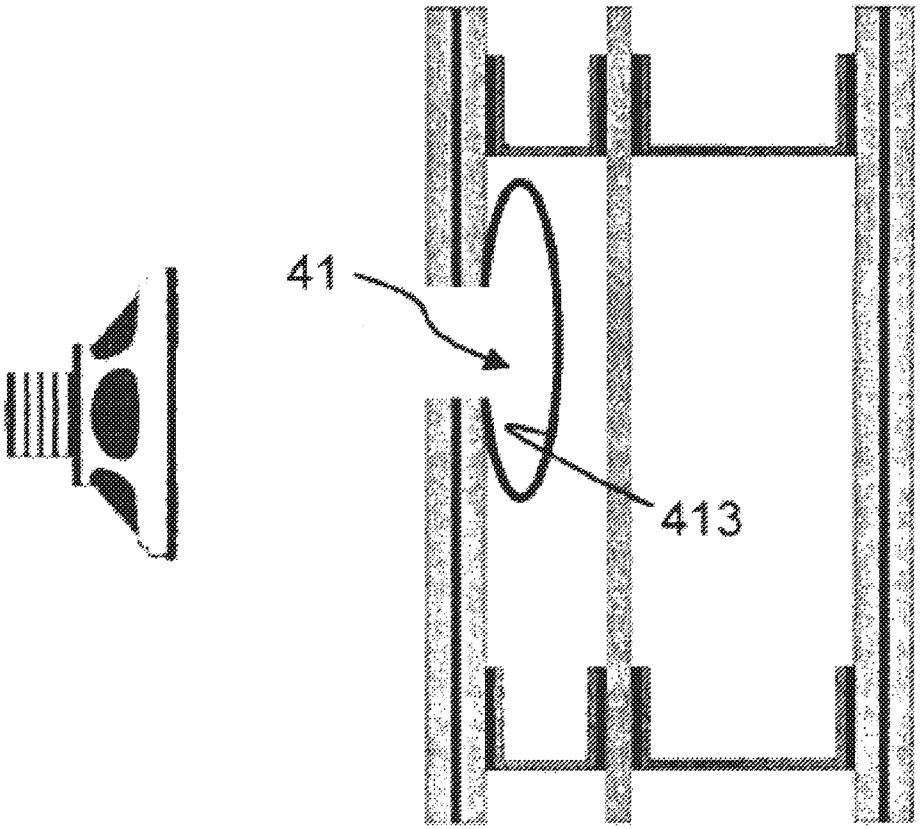
FIG. 7 shows resonance chambers.

Different embodiments for the resonance chamber are shown in FIG. 5, FIG. 6 and FIG. 7. In FIG. 5, the drywall construction comprises a further resonance chamber 43 which is in the shown example in fluid contact to the resonance chamber 41. That means the opening 42 of further resonance chamber 43 is arranged in resonance chamber 41. FIG. 6 shows a resonance chamber having a separate outer wall 413 of a box shape and FIG. 7 shows a resonance chamber 41 having a separate outer wall 413 of a tube shape. In particular the size and shape of the resonance chambers having a separate outer wall 413 and the opening can be easily chosen to attenuate predetermined frequencies. Frequencies below 125 Hz are preferred, wherein the size and shape can be chosen to be adjustable to allow for adjusting the frequencies to be attenuated. In the tube shape example this can be a tube-in-tube arrangement. The relative movement of the tubes can be used to change the volume of the resonance chamber.

What is claimed is:

1. Drywall construction for resonance sound absorption, the drywall construction comprising a plurality of drywall profiles and fixed thereto at least one layer of plasterboards having an opening arranged therein, the drywall construction comprising a resonance chamber in fluid connection with the opening, a size and a shape of the resonance chamber and the opening being dimensioned such that at least one resonance frequency of the resonance chamber conforms to at least one frequency of sounds to be absorbed, and wherein the resonance chamber has a size of $V=(c^2/4\pi^2/)(s/lf^2)$, wherein c is the sound velocity in air, s is the cross-section of the opening, l is the thickness of the opening and f the frequency to be absorbed, and wherein the resonance chamber has a size V for the attenuation of sound of a frequency $f<125$ Hz.

2. The drywall construction according to claim 1, further comprising an elastic element for acoustic decoupling of the profile and the plasterboard, the elastic element being arranged between the drywall profile and the layer of plasterboards fixed thereto.

3. The drywall construction according to claim 1, wherein the opening has a size of the dimensions s=0.01 m×0.1 m and l=0.025 m.

4. The drywall construction according to claim 1, wherein a sound attenuation element is arranged in the resonance chamber, and wherein the drywall construction comprises one layer of plasterboards fixed to the drywall profiles, wherein the resonance chamber is arranged at a side of the one layer of plasterboards which is fixed to the drywall profiles.

5. The drywall construction according to claim 1, the drywall construction comprising two layers of plasterboards, a first of which being fixed to a first side of the drywall profiles, and a second of which being fixed to a second side of the drywall profiles arranged opposite to the first side, and wherein the resonance chamber is arranged between the two layers of plasterboards.

6. The drywall construction according to claim 1, the drywall construction comprising three layers of plasterboards, the first of which being fixed to a first side of the drywall profiles and the second of which being fixed to a second side of the drywall profiles, wherein a further plurality of drywall profiles is fixed to one of the first layer or the second layer of the three layers of plasterboards, a third layer of the three layers of plasterboards being fixed to the further plurality of drywall profiles, and wherein the resonance chamber is arranged between two layers of the three layers of plasterboards.

7. The drywall construction according to claim 6, wherein a further resonance chamber is arranged between two other layers than the two layers between which the resonance chamber is arranged, the further resonance chamber being in fluid connection with a further opening.

8. The drywall construction according to claim 1, wherein at least one of the at least one layer of plasterboards is a double layer of plasterboards.

9. The drywall construction according to claim 8, further comprising an elastic lining arranged between the double layer of plasterboards.

10. The drywall construction according to claim 1, wherein the resonance chamber comprises an outer wall of a plasterboard, and wherein the at least one layer of plasterboards is at least a portion of the outer wall.

11. The drywall construction according to claim 1, wherein the resonance chamber comprises a separate outer wall.

12. The drywall construction according to claim 11, wherein the separate outer wall has a box shape or a cylindrical shape.

* * * * *